US007081014B2

(12) United States Patent
Pan et al.

(10) Patent No.: US 7,081,014 B2
(45) Date of Patent: Jul. 25, 2006

(54) ELECTRICAL CONNECTOR WITH IMPROVED BOARD LOCK

(75) Inventors: Wei-Hua Pan, Kunsan (CN); Zhi-Qiang Li, KUnsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/028,030

(22) Filed: Dec. 31, 2004

(65) Prior Publication Data

US 2005/0272308 A1 Dec. 8, 2005

(30) Foreign Application Priority Data

Jun. 4, 2004 (CN) ..... 2004 2 0277139 U

(51) Int. Cl.
*H01R 13/60* (2006.01)

(52) U.S. Cl. ..... 439/567; 439/660

(58) Field of Classification Search ..... 439/567, 439/660, 570–573
See application file for complete search history.

(56) References Cited

U.S. PATENT DOCUMENTS 4,907,987 A * 3/1990 Douty et al. ..... 439/571
5,244,414 A 9/1993 Peloza
6,027,371 A 2/2000 Lin et al.
6,042,420 A * 3/2000 Long ..... 439/570
6,074,249 A * 6/2000 Beken et al. ..... 439/567
6,106,331 A * 8/2000 Kurotori et al. ..... 439/567
6,210,218 B1 * 4/2001 Chang ..... 439/567
2005/0124192 A1 * 6/2005 Tang et al. ..... 439/153

* cited by examiner

*Primary Examiner*—Ross Gushi
(74) *Attorney, Agent, or Firm*—Wei Te Chung

(57) ABSTRACT

An electrical connector adapted for mounting on a Printed Circuit Board (PCB), comprises an insulative housing, a plurality of terminals loaded in the insulative housing and a board lock device assembled in the insulative housing. The insulative housing comprises a base portion having a PCB mounting face and a mating portion extending from the base portion. The base portion defines a boardlock-receiving cavity and is formed with a block adjacent to the cavity. The board lock device comprises a retaining plate retained in the cavity and substantially parallel to the PCB mounting face of the base portion and a lock plate perpendicularly extending from the retaining plate beyond the PCB mounting face of the base portion for locking with the PCB. The retaining plate is supported by the block for preventing the board lock device from moving along a direction perpendicular to the PCB mounting face of the base portion.

3 Claims, 3 Drawing Sheets

ELECTRICAL CONNECTOR WITH IMPROVED BOARD LOCK

BACKGROUD OF THE INVENTION

1. Field of the Invention

The present invention relates to an electrical connector, and more particularly to an electrical connector having a board lock for mounting the electrical connector on a surface of a printed circuit board.

2. Description of the Prior Art

Generally, an electrical connector is mounted onto a Printed Circuit Board (PCB) for signal transmission. Fastening means are provided for securing a housing of the electrical connector to the PCB to afford strain relief to prevent inadequate engagement of terminals of the electrical connector with the PCB, breaking of solder interfaces between the terminals and the PCB, and/or inadequate engagement of the terminals with mating terminals of another complementary connector mated to the electrical connector. Such means often are called "boardlocks" projecting from an engaging face of the housing into holes in the PCB.

U.S. Pat. No. 5,244,414 discloses a conventional board lock system. The board lock system comprises a boardlock-receiving cavity at one side of the housing with an open top at one side of an upper face of the housing and a boardlock device insertable into the open top of the cavity. However, in this configuration, the assembly difficulty of the boardlock device is increased as the engagement reliability between the boardlock device and the housing increased. In other word, in order to ensure the boardlock device to be reliably retained in the housing, the assembly of the boardlock device into the housing will require a large force. Furthermore, the large force during assembling the boardlock device might result in the housing to be destroyed.

Hence, an improved board lock device of an electrical connector is desired to overcome the disadvantages of the prior art.

SUMMARY OF THE INVENTION

Accordingly, an object of the present invention is to provide an electrical connector, and particularly to an electrical connector having an improved board lock device simply assembled into and reliably retained in an insulative housing thereof.

To achieve the above objects, an electrical connector adapted for mounting on a Printed Circuit Board (PCB), comprises an insulative housing, a plurality of terminals loaded in the insulative housing and a board lock device assembled in the insulative housing. The insulative housing comprises a base portion having a PCB mounting face and a mating portion extending from the base portion. The base portion defines a boardlock-receiving cavity and is formed with a block adjacent to the cavity. The board lock device comprises a retaining plate retained in the cavity and substantially parallel to the PCB mounting face of the base portion and a lock plate perpendicularly extending from the retaining plate beyond the PCB mounting face of the base portion for locking with the PCB. The retaining plate is supported by the block for preventing the board lock device from moving along a direction perpendicular to the PCB mounting face of the base portion.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
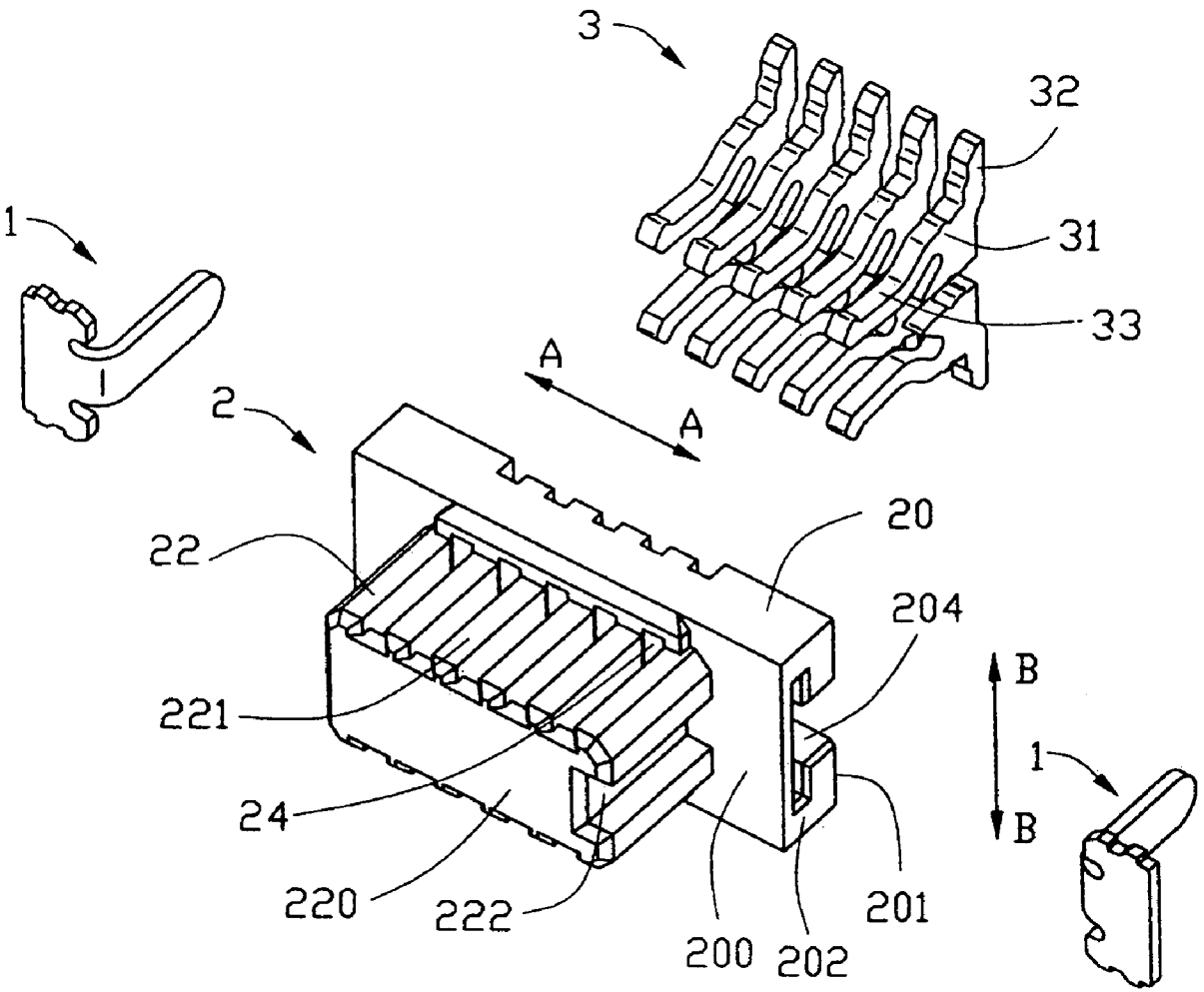
FIG. 1 is an exploded perspective view of an electrical connector in accordance with the present invention.

Referring to FIG. 1, an electrical connector of the present invention adapted for mounting onto a Print Circuit Board (PCB) (not shown) comprises a unitarily molded insulative housing 2, a plurality of terminals 3 assembled into the insulative housing 2, a board lock device 1 retained in the insulative housing 2 and adapted for mounting on a surface of the PCB.

Referring to FIG. 1, the insulative housing 2 defines a longitude direction A and a transverse direction B perpendicular to the longitude direction. The housing 2 has an elongated base portion 20 and an elongated mating portion 22 projecting from an upper face 200 of the base portion 20. A plurality of passageways 24 is provided in the insulative housing 2 and is aligned in two lines along the longitude direction of the housing 2. Each passageway 24 extends from a PCB mounting face 201 of the base portion 20 toward a top face 220 of the mating portion 22 and is partially exposed in a side face 221 of the mating portion 22. In conjunction with referring to FIG. 2, the terminals 3 are loaded into the insulative housing 2 from the PCB mounting face 201 of the base portion 20. Each terminal 3 is provided with a retaining section 31 reliably fitted the terminal 3 in corresponding passageway 24, a contact section 33 extending from an upper end of the retained section 31 and exposed into the side face 221 of the mating portion 22, and a solder section 32 extending from an lower end of the retaining section 31 and exposed in the PCB mounting face 201 of the base portion 20 for electrically connecting a corresponding pad disposed in the PCB. A pair of guiding slot 222 is provided at opposite longitude ends for guiding the mating of a complementary connector (not shown), respectively.

Figure 2:
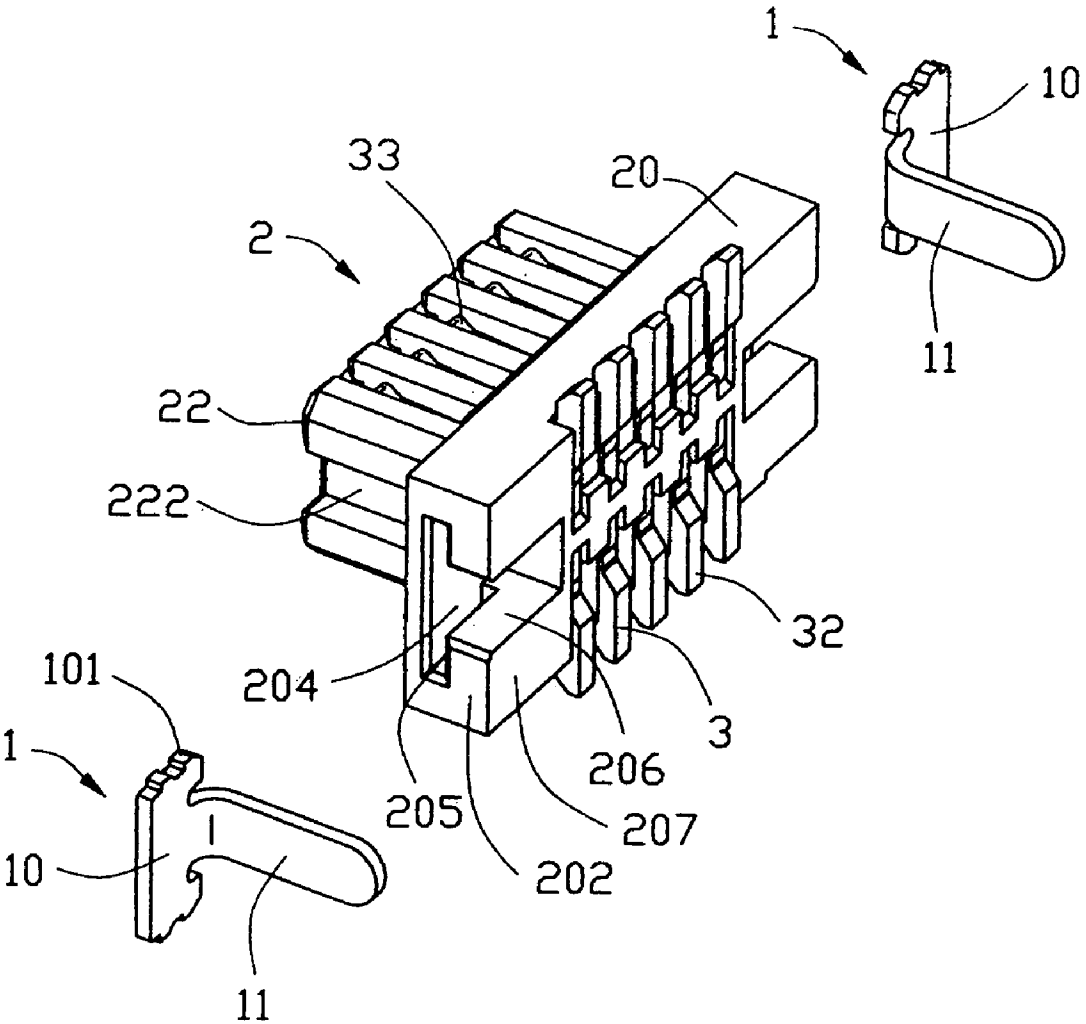
FIG. 2 is an assembled perspective view of the electrical connector shown in FIG. 1, with a board lock device exploded.

Referring to FIGS. 1 and 2, the base portion 20 is configured with a pair of boardlock-receiving cavities 204 in opposite longitude side faces 202 thereof, respectively. The cavity 204 has a parallel section 205 substantially parallel to the PCB mounting face 201 of and a vertical section 206 communicating with the parallel section 205 and passing throughout the PCB mounting face 201 of the base portion 20. A pair of blocks 207 is provided on the base portion 20 and extends into the cavity 204 by configuring a dimension of the parallel section 205 to be larger than a dimension of the vertical section 206 along the transverse direction B of the housing 2.

Figure 3:
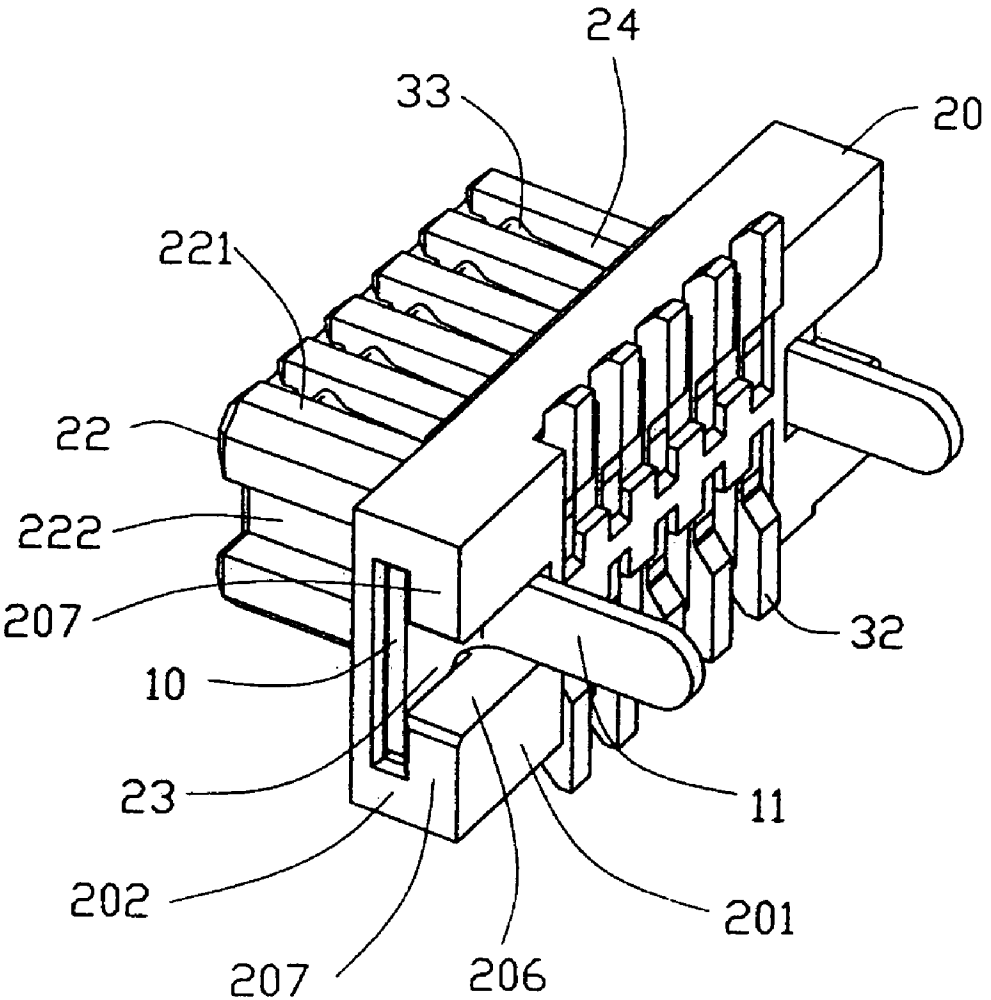
FIG. 3 is an assembled view of the electrical connector shown in FIG. 1.

Referring to FIGS. 2 and 3, the board lock device 1 has a pair of board lock members, which is formed and stamped from a metal sheet, loaded from the side face 202 of the base portion 20 into the boardlock-receiving cavities 204 along the longitude direction A of the housing, respectively. Each board lock member comprises a retaining plate 10 snugly received in the parallel section 205 and supported by the blocks 207 of the base portion 20 for reliably preventing the board lock member from moving vertically. The retaining plate 10 is formed with a plurality of retaining bars 101 at opposite transverse edges thereof engaging with inner walls of the parallel section 205. A lock plate 11 perpendicularly extends from an inner longitude edge of the retaining plate 10 adjacent to the terminals 3 and pass through the vertical section 206 beyond the PCB mounting face 201 of the base portion 20 for mounting on the PCB. The lock plate 11 is configured in a plane-shape member, which defines a plane perpendicular to the longitude direction A of the housing 2 for reliably fasten the electrical connector onto the PCB along the transverse direction B.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

an insulative housing defining a lengthwise axis;

a plurality of contacts disposed in the housing;

a pair of cavities formed at two ends of a bottom portion of the housing, each of said cavities defining a T-shaped cross-sectional configuration which communicatively faces toward an exterior in a first direction along said longwise axis; and a pair of board locks each defining a horizontal retaining plate and a vertical lock plate respectively received in a corresponding horizontal section and a vertical section of a T-shaped cross-section configuration; wherein said board lock is horizontally assembled to the corresponding cavity in a second direction opposite to said first direction, and the lock plate extends from an inner edge of said retaining plate.

2. The electrical connector as claimed in claim 1, wherein said contacts are arranged with two rows along the first direction, and the vertical lock plate is located between said two rows.

3. An electrical connector adapter to mount on a Printed Circuit Board (PCB), comprising:

An insulative housing defining a PCB mounting face and a pair of opposite side face, and having a pair of cavities communicating the side faces respectively and a pair of opposite blocks adjacent to each cavity, each cavity having a parallel section substantially parallel to the mounting face and a vertical section formed between the pair of blocks and communicating to the mounting face and the parallel section;

a plurality of terminals arranged in the insulative housing; and a pair of board lock devices each comprising a retaining plate received in the parallel section, and a lock plate perpendicularly extending from the retaining plate and throughout the vertical section for locking with the PCB, each retaining plate being supported by its opposite fringes confronting one pair of the blocks for preventing the board lock device from moving along a direction perpendicular to the mounting face; wherein the lock late extends from of the retaining plate adjacent to the terminals.

* * * * *